United States Patent [19]

Castello et al.

[11] Patent Number: 4,575,176

[45] Date of Patent: Mar. 11, 1986

[54] MANUFACTURE OF PIN HEADERS

[75] Inventors: Paolo Castello; Claudio Tartari, both of Turin, Italy

[73] Assignee: AMP Incorporated, Harrisburg, Pa.

[21] Appl. No.: 621,276

[22] Filed: Jun. 15, 1984

[51] Int. Cl.[4] ..... H01R 33/04

[52] U.S. Cl. ..... 339/195 M; 339/221 M; 339/276 SF

[58] Field of Search ..... 339/276 SF, 221 R, 221 M, 339/262 R, 195 M

[56] References Cited

U.S. PATENT DOCUMENTS

| | | | |
|---|---|---|---|
| 3,083,369 | 4/1963 | Peterson et al. | 1/56 |
| 3,621,444 | 11/1971 | Stein | 339/221 M |
| 3,837,063 | 9/1974 | Wright | 29/203 P |
| 3,932,931 | 1/1976 | Wright | 29/626 |
| 3,990,768 | 11/1976 | Faber | 339/262 R |
| 4,035,047 | 7/1977 | Ammon | 339/221 M |
| 4,056,300 | 11/1977 | Schumacher | 339/221 M |
| 4,127,934 | 12/1978 | Bartley et al. | 29/626 |
| 4,243,289 | 1/1981 | Kozel | 339/221 M |
| 4,318,964 | 3/1982 | Zahn et al. | 206/329 |
| 4,369,572 | 1/1983 | Atkins | 339/276 SF |
| 4,408,824 | 10/1983 | Weidler | 339/278 C |

FOREIGN PATENT DOCUMENTS

OL2348674 9/1983 Fed. Rep. of Germany .

OTHER PUBLICATIONS

Data Sheet 501, Dec. 1982–Berg Solder–Washer–Berg-Pin.

*Primary Examiner*—Gil Weidenfeld
*Assistant Examiner*—Gary F. Paumen
*Attorney, Agent, or Firm*—Robert W. J. Usher

[57] ABSTRACT

A method of making a pin header in which pins of discrete length are severed from drawn wire stock and secured by welding to a metal carrier strip. The pins are then carried by the strip through a plating bath. The strip is subsequently severed to free individual pins attached to a residual strip portion and the individual pins are inserted into an insulating carrier with the residual strip portions received in the carrier in an interference fit.

2 Claims, 7 Drawing Figures

MANUFACTURE OF PIN HEADERS

The invention relates to the manufacture of pin headers for printed circuit boards.

It is common practice to manufacture pin headers for printed circuit boards by stamping and forming the individual pins on a metal carrier strip, plating predetermined portions of the pins, and subsequently severing the individual pins from the carrier strip and inserting them into insulating housings.

However, the stamping and forming operation is relatively expensive and attempts have therefore been made for many years to manufacture the pin headers by severing the individual pins from drawn wire stock, mechanically attaching (e.g, by crimping or press fitting) the pins to a metal carrier strip, selectively plating the pins and subsequently removing the individual pins from the carrier strip for insertion into an insulating housing.

Problems have arisen, however, in obtaining a mechanical attachment which provides both a reliable electrical connection between the individual pins and the carrier strip allowing a reliable plating operation and enables the individual pins readily to be detached from the carrier strip for insertion into the housing.

It is an object of the invention to avoid the abovementioned disadvantages.

According to the invention, there is provided a method of making a pin header for a printed circuit board, by severing individual pins of discrete length from drawn wire stock, welding the individual pins intermediate their ends at spaced intervals along a metal carrier strip, plating the pins and subsequently severing the carrier strip at locations between adjacent pins to leave portions of the carrier strip attached to the pins and inserting the individual pins into an insulating housing with the portions of the carrier strip attached to the pins received in an interference fit in the housing.

The individual pins are, preferably, attached to the carrier strip by a spot welding process.

Desirably, the carrier strip provides, after severing, residual wing portions extending laterally from opposite sides of the individual posts and the housing is formed with a cavity of T cross-section to accommodate the post portion and wings in an interference fit.

The method of the invention obviates the conflicting requirements of providing both a good electrical and readily separable mechanical connection between the pins and carrier strip by permitting a portion of the carrier strip to remain connected to the pin during insertion into the housing enabling the reliable welding connection to be used.

The residual portions of the carrier strip may enhance the stable retention of the pins in the insulating housing and provide a stop against over-insertion in the housing in the axial direction. Where round pins are used, the residual portions of the carrier strip effectively resist rotation of the pins within the housing without a requirement for any additional notching or dimpling operation being performed on the pin itself as frequently resorted to in the prior art.

According to another aspect of the invention, there is provided a pin header for a printed circuit board comprising a plurality of plated pins anchored in an insulating housing with opposite ends protruding from different faces of the housing, each pin being of drawn wire stock and attached by welding to a strip portion received in the housing as an interference fit.

Preferably, the strip portion extends from respective opposite sides of the pin and the housing is formed with a T-section cavity receiving the pin and strip as an interference fit.

An example of the invention will now be described with reference to the accompanying drawings in which.

Figure 1A:
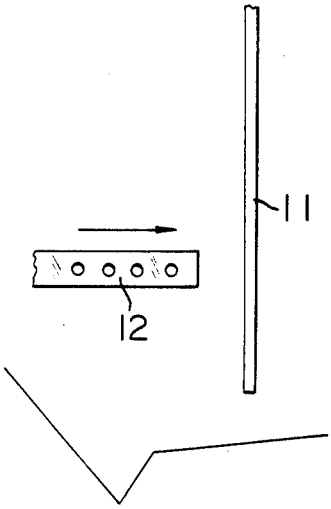
FIG. 1 (*a–d*) is a schematic perspective showing successive steps in the manufacture of a pin header according to the invention.
Figure 1B:
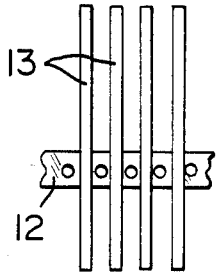
Figure 1C:
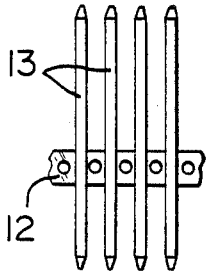
Figure 1D:
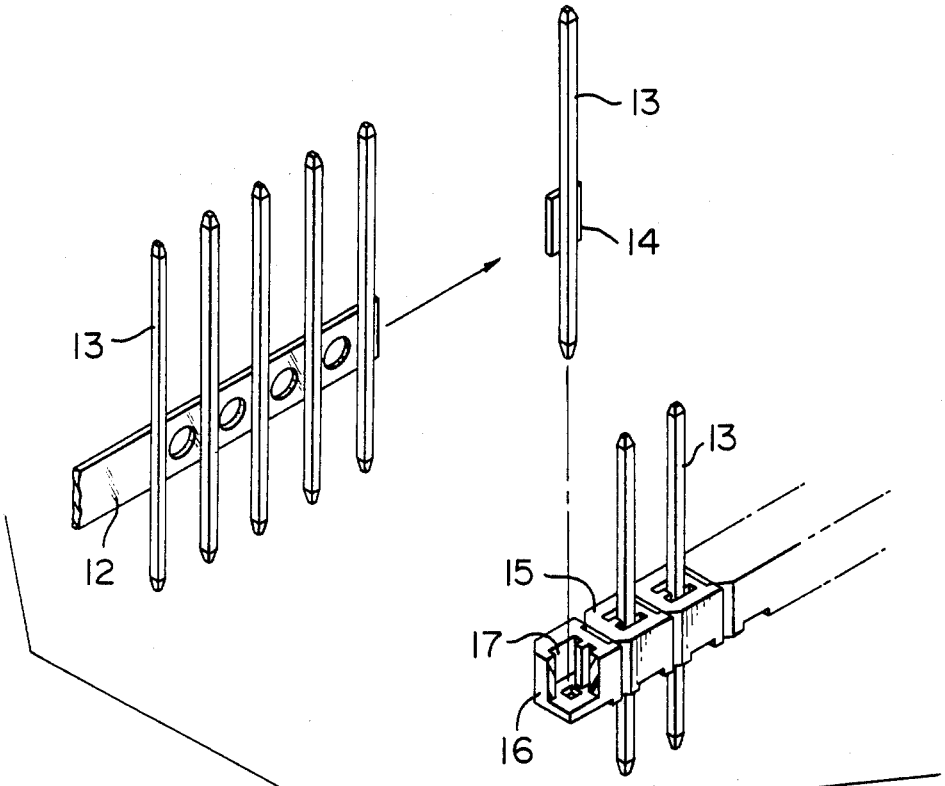
Figure 2:
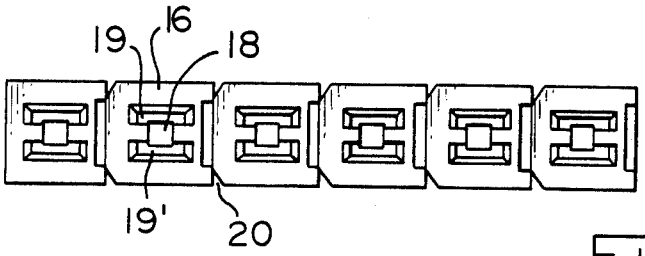
FIG. 2 is a plan view of the header housing.
Figure 3:
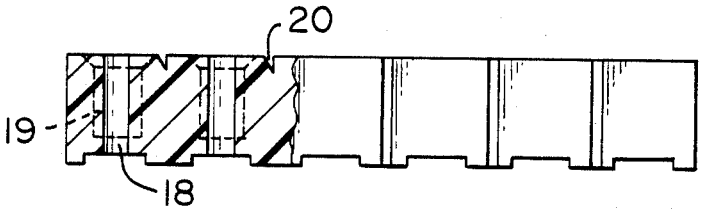
FIG. 3 is a longitudinal cross-sectional view of the header housing.
Figure 4:
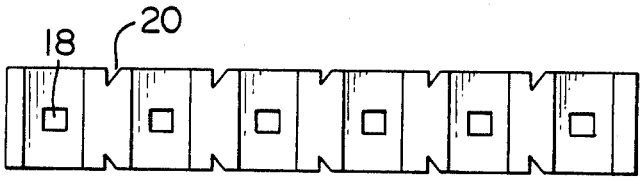
FIG. 4 is an underplan of the header housing.

As shown schematically in FIG. 1 (*a–d*), drawn wire stock 11 and a metal carrier strip 12 are fed along intersecting paths (FIG. 1*a*), and individual pins 13 are severed from the stock and spot welded at locations between their ends onto the carrier strip at longitudinally spaced intervals (FIG. 1*b*). Tips may then be formed on the respective ends of the pins (FIG. 1*c*) and the pins carried by the strip selectively plates (not shown) in a bath. The strip is subsequently severed at locations between the pins and the individual pins with residual portions 14 of the carrier strip attached staked in a suitable header housing 15 (FIG. 1*d*).

As shown in FIG. 1*d* and FIGS. 2–4, the header housing 15 comprises an elongate moulded strip defining integrally joined individual pin receiving modules 16. Each module is formed with a pin-receiving cavity 17 having a central cavity portion 18 conforming to the square cross-section of the pin and communicating at respective opposite sides with elongate lateral cavity portions 19, 19' for receiving portions 14 of the carrier strip as an interference fit when the post is staked in the housing. The central and a lateral cavity portions are of T-section to conform with the cross-section of the pin with residual wing portions. The lateral cavity portions 19, 19' are blind-ended being closed at the base of the housing so that engagement of the residual strip portions 14 with the ends prevents over-insertion of the posts. It should be noted that the depressions 20 in upper and side faces of the housing provide points of weakness enabling individual modules or groups of modules readily to be broken apart to provide a header of desired length. The provision of two lateral cavity portions 19, 19' in a single module enables receipt of the pin in either of two orientations of the residual stop portions is although, in some circumstances, more accurate guiding of the pin during insertion into the housing may be obtained by having only one lateral cavity.

It will be appreciated that the pins can be of any desired cross-sectional shape, e.g., circular or rectangular, and may be bent about transverse axes to form right angled headers.

We claim:

1. A pin header for a printed circuit board comprising a plurality of plated pins anchored in an insulating housing with opposite ends of the pins protruding from different faces of the housing, each pin being of drawn wire stock and attached by welding to a severed metal carrier strip portion received in the housing as an interference fit.

2. A pin header according to claim 1 in which the strip portion extends from respective opposite sides of the pin and the housing is formed with a T-section cavity receiving the pin and strip as an inteference fit.

* * * * *